US005956827A

United States Patent [19]

Vieri

[11] Patent Number: 5,956,827

[45] Date of Patent: Sep. 28, 1999

[54] APPARATUS FOR FAST RETURN OF THE YARN INTO THE CHANNELS OF WARPERS WITH THREAD-BY-THREAD WARPING SYSTEM

[75] Inventor: Roberto Vieri, Prato, Italy

[73] Assignee: Sukuki Warper Ltd., Gumma, Japan

[21] Appl. No.: 08/953,147

[22] Filed: Oct. 17, 1997

[30] Foreign Application Priority Data

Oct. 31, 1996 [IT] Italy ..... FI96A0256

[51] Int. Cl.[6] ..... D02H 3/00

[52] U.S. Cl. ..... 28/193; 28/191

[58] Field of Search ..... 28/193, 190, 191, 28/192

[56] References Cited

U.S. PATENT DOCUMENTS

| | | | |
|---|---|---|---|
| 4,765,041 | 8/1988 | Baltzer | 28/191 |
| 4,768,734 | 9/1988 | Kusters | 28/193 |
| 5,628,098 | 5/1997 | Beerli et al. | 28/191 |

FOREIGN PATENT DOCUMENTS

| | | |
|---|---|---|
| 0 375 480 A2 | 6/1990 | European Pat. Off. . |
| 0 652 310 A1 | 5/1995 | European Pat. Off. . |
| 1 227 398 | 10/1966 | Germany . |
| 38 21 534 | 1/1990 | Germany . |
| 40 17 359 C1 | 8/1991 | Germany . |
| 44 46 279 C1 | 6/1996 | Germany . |

*Primary Examiner*—Andy Falik

*Attorney, Agent, or Firm*—McGlew and Tuttle, P.C.

[57] ABSTRACT

An apparatus is disclosed for the formation of yarn turns on a warper support. The yarn is loaded onto a support intended for a samples weaving loom, in a warper utilizing a suitably programmed thread-by-thread warping system. The apparatus includes a support for thread turns and a thread holding member with a thread-guide driven into continuous motion for drawing a thread along and forming the thread turns on the support. A thread device for retaining and presenting and recovering thread from the thread holding member is provided which includes a plurality of members each of which handles thread coming from a creel. A release system for the release of thread from the thread-guide of the thread holding member is provided. The release system has a plurality of release devices associated in close proximity to the members of the thread device. Each of the release devices is selectively controlled to operate the release of at least one of the threads. One of the release devices is disposed immediately downstream, with respect to a direction of motion of the thread holding member, of the plurality of members. The provision of the plurality of release devices and the location of these in close proximity to the members of the thread device avoids the considerable double length of yarn and avoids time to recover this which is requires in the prior art devices.

6 Claims, 11 Drawing Sheets

9
11
21
23
25
1
3
5
7
13
15
17
19
19A
29
S
VII
III
F1
F2
F3
Fx
Fy
fV
fIV

APPARATUS FOR FAST RETURN OF THE YARN INTO THE CHANNELS OF WARPERS WITH THREAD-BY-THREAD WARPING SYSTEM

FIELD AND BACKGROUND OF THE INVENTION

The present invention refers to an apparatus for releasing the warp yarn for warping machines which perform the preparation of warps with the thread-by-thread system, that is, with one thread at a time, like the Hergeth or Suzuky warpers or equivalent, for the preparation of the warp yarn to be wound on beams intended for weaving looms for the production of fabric samples.

One object of the invention is to increase the production of the warpers, while reducing dead times and increasing the working speed thereof, as well as increasing the number of the yarn colors to be worked.

SUMMARY AND OBJECTS OF THE INVENTION

The invention provides modifications in the system used for the thread-by-thread warping, allowing the release of the warp threads every time the warp pattern requires the input of a thread other than that previously wound and which must return to rest or stand-by condition.

FIGS. 1 to 9 illustrate very schematically an apparatus comprising the warper in question, in its current construction, to help understanding how the warping is currently performed by the above indicated thread-by-thread warper of Suzuky type.

In particular,

FIG. 1 shows a layout of the warper on which the yarn is wound in turns, that is coils, to be transferred afterwards onto the beam;

FIG. 2 shows a layout of the plant;

FIG. 3 is a view taken on line III—III of FIG. 2;

FIG. 4 is an enlarged detail of the region indicated by the arrow fIV of FIG. 2;

FIG. 5 is a side view according to arrow fV of FIG. 2;

FIG. 6 is a view taken substantially on line VI—VI of FIG. 5;

FIG. 7 is a view in local section taken substantially on line VII—VII of FIG. 2;

FIG. 8 shows two details of the section taken on line VIII—VIII of FIG. 7;

FIG. 9 shows a detail of the region indicated by the arrow fIX of FIG. 5 to illustrate the functionality of the release device;

FIG. 10 shows schematically, likewise FIG. 1, the layout of the Hergeth machine.

In the FIGS. 1 to 9, numeral 1 indicates the reel-holding group, 3 indicates the creel which feeds the threads coming from the reels or bobbing 5 and suitably supplied by the systems 7 of known type to the warping machine 9, the latter taking them up intermittently for the formation of turns S of yarn to be wound afterwards on the beam 11 (see FIG. 11). The various threads F1, F2, F3 . . . FN form relatively long spans between the creel 3 and the retention and delivery group which is indicated by 13 and belongs to the warper. Each of these threads F1, F2, F3 . . . FN is associated, within the free span, to a respective recovery system of storage type which comprises a disk 15 with a hole through which the thread is made to pass and which is movable along vertical guides 17 (see FIGS. 2 and 3), so that the weight of each disk 15 ensures a sufficient tensioning of the respective thread both in rest and feed conditions.

For the formation of the warp to be transferred onto the beam 11 during a subsequent stage, the warper is provided with a cylindrical support and with a thread-holding arm 23, mounted through a ball bearing 21 in correspondence of the geometrical horizontal axis of this cylindrical support 19, capable of rotating and having at its end a thread-winding hook, or simply stated, a thread-guide 25 which, by engaging the thread to be fed, drives the latter through a circumferential path to form the-turns S on the cylindrical support 19. This cylindrical support 19 exhibits a series of continuous straps 19A which run longitudinally and parallel to the geometrical axis of the same support, the turns S being laid down on the outer length of said straps; during the work these continuous straps 19A are moved according to arrow f19 parallel to said axis so as to displace the whole of the formed turns and make room for the formation of the new ones at the end of the cylindrical support, the thread-holding arm 23 together with the thread-guide 25 being made to rotate adjacent to said end. The thread-guide 25 is intended to catch, along its trajectory, the thread—possibly presented to it—for drawing it back from the creel 3 along the pertinent trajectory F1, F2, F3 . . . FN, in order to lay down the turns, in a number as preset by the programming of the warp to be formed, by compensating for the trajectory variations of the span FY by means of the storage member represented by the disk 15 which moves along the guides 17 according to the variation of the free span during the circumferential drive by the thread-guide 25; the rate of these displacements of the pierced disk 15 will depend on the frequency of rotation of the thread-holding arm 23, the accelerations and decelerations of these disks being relatively limited also in case of a relatively high rotational speed of the thread holding arm. Associated to the cylindrical support 19 is a crossing system (FIGS. 2, 7 and 8) which exhibits at least a turn or more turns of stems 29 which develop parallel to the outer active branches of the transfer straps 19A and each exhibiting, at its end, a thread-catching system indicated by 29A and 29B and acting on opposite directions with a cyclic displacement of the appendix 29A so as to cause the turns to be laid down in a cross pattern onto the stems 29 (as shown in particular in FIG. 7) in correspondence of the length between two straps 19A; such cross arrangement of the turns S prevents the latter from overlapping during the dwell and the longitudinal transfer along the cylindrical support 19. Provided within the thread-retaining group 13 at the end of the free span, between the creel and the same group 13, is an assembly of septa or member 31 and relevant shanks 33, which form channels for guiding the relevant threads which reach the group 13 from the creel. Combined with the channels formed by the members 31, 33, there are provided oscillating hooks 35 able to move from a rest position 35A to an opposite position 35B through intermediate positions, under the control of solenoid devices designated by 35S (see FIG. 5). The threads indicated by FX in FIGS. 4 and 6 are excluded by the trajectory of the thread-guide 25 carried by the thread-holding arm 23 and rotating about the ball bearing 21, while a thread FY—displaced by the oscillating hook 35 which moves from position 35A to position 35B—is intercepted and picked up by the thread-guide 25 to be driven about the cylindrical support 19 for the formation of turns of thread FY in a number established by the program. In order to ensure the guiding of the thread FY held by the thread-guide 25 after the seize thereof, along the periphery of the cylindrical support 19 and in the region of the group 13 for the hold of the thread, two shaped cams 37 and 39 are provided, commonly indicated as "thread cam or thread-guide cam" or "thread-guide" and "saber cam", respectively, along the active edges of which the thread FY is made to slide when picked up and driven by the thread-guide 25. Indicated by 41 is a release system with an angularly movable member (see FIGS. 5 and 6), which is located downstream of the group 13 with respect to the winding direction of the turns as indicated by the arrow fA. This is a single release system spaced apart from the individual members 31 and 33 which form the thread guiding channels and cooperate with the respective oscillating hooks 35. When the release system is brought to the active position, it interferes with the thread FY driven by the thread-guide 25 of the rotating thread-holding arm 23, so as to cause the disengagement of the thread FY from the thread-guide 25, as indicated in particular in FIG. 9 by the arrow FB. Since the release system 41 is but one for all the threads which reach the thread retaining and positioning group 13 at the end of spans F1, F2 . . . FN, and since this release system must be positioned at a significant distance from this group 13, the thread released from the thread-guide 25 of the rotating thread-holding arm 23 must therefore be recovered in order to be positioned as indicated with FX, by recovering the thread which—after being abandoned by the thread-guide 25—exhibits a considerable double length between the end of trajectory of said thread, already driven by the thread-guide 25, and the channel thereof formed by the members 31, 33. Until now, in order to recover this length of thread, it has been necessary to resort to the system of the pierced disks 15, according to which the disk 15 of the thread just abandoned by the thread-guide 25, by the action of the release system 41, is to be lowered with a velocity higher than that of the periodic oscillations due to the winding of the turn, so as to recover the thread and place it in the FX position before the thread-guide 25 being able to pick up a different thread intended to form the next turns and be timely positioned by the oscillating hook 35 that would be moved to position 35B. In conclusion, it is necessary that the rotational speed of the thread-holding arm 23 be relatively limited and that said thread-holding arm 23, after having abandoned (by means of the release system 41) a thread which has ceased to form turns, makes one or more rounds before the previously abandoned thread will take up the rest condition and that, consequently, the oscillating hook 35 associated to the thread which must start to form the turns on the cylindrical support 19, be moved by its own oscillating hook 35 to the position 35B, to be grasped by the thread-guide 25 upon one of the passages of such thread-guide in front of the group 13. This operation—which takes a relatively long time to be carried out—is responsible for the limited production of the warper, both because the rotational speed of the thread holding arm 23 is to be restricted to certain limits, and because said thread holding arm 23 must perform a certain number of idle revolutions before reaching the conditions of holding a new thread for the displacement of a relevant oscillating hook 35.

The object of the invention is an apparatus for the fast return of the yarn into the warpers of the system above described, in order to overcome the above mentioned drawbacks and thus increasing the warper productivity.

The same problem is present (perhaps more markedly) also in the machines of the Hergeth type, a schematic representation of which is shown in FIG. 10, wherein the support for the turns, instead of being cylindrical as the one above described and indicated by 19, is made up of a set of belts 119A driven out between drums 119B and 119C spaced between them; a group 113 of presentation and retention of the threads coming from the creel is developed along the periphery of the drum 119C from which the belts 119A are driven out and in which members are provided equivalent to those indicated by 31 and 33 of group 13 of the previously indicated system. The Hergeth warper exhibits a different shape of the support whose development is substantially vertical instead of cylindrical. In this case, the thread-holding hook (equivalent to 25) is borne by a belt which moves between two pulleys located at opposite ends of the vertical support and coaxial to drums 119B and 119C. Also in this case, an assembly of motor-driven belts—orthogonally disposed with respect to the vertical development of the support—is intended to move the warp turns forwards in horizontal direction with respect to the vertical development of the support, likewise the belts 19A.

Another drawback of the above described existing arrangements which are known (prior art) is that the number of threads that can be held by the devices provided in the groups 13 or 113 must be relatively limited in order to limit, as much as possible the extent of the thread length to be recovered during the change of thread to be wound up, so that the threads at the two ends of the retention and displacement means such as those indicated by 31, 33 and 35 of the group 13 or equivalent group 113, behave relatively little differently between them. This limits the possibility of formation of warp patterns. The subject apparatus overcomes these drawbacks of the known arrangements.

In conclusion, in the existing systems (FIGS. 1–10) the warping is carried out through operations which are of a strictly sequential character, that is, the different threads F which form the warp are wound up onto a support 19, 119 in the form of turns S orderly arranged close to each other, and the warper winds up the different threads through different operations performed successively. The different threads are picked up from the storage system (reel-holding creel 13) only when the thread is made to wind up on the warper by following the sequence provided to achieve the warp pattern. The number of thread changes, the number of different threads and, in general, the different number of colours and the sequence and frequencies of picking up the threads, are determined by the warping programming which shall reflect the design of the warp of the fabric to be completed upon the next weaving step.

In order to point out the usefulness and novelty of the invention to be described later on, a compendium is provided below of the operations carried out by the warper during the thread change stage, that is, upon the request of a new thread. Under these circumstances, it is necessary: that the thread, which has last formed the turns, be released from the thread-holding hook 25, be re-disposed in place by the oscillating hook 35 within its own channel of members 31, 33; and that only afterwards the new thread necessary for the warping be hooked up by its oscillating hook 35 onto the thread-guide 25 of the arm 23. The above indicated operations must be carried out in sequence before the active step of warping (winding the thread on the support) be started again. The described operations, to be performed at every change of thread, require a determined time. The rate of thread changes is determined by the total length of the warp, by the number of threads necessary for the making of the warp and by the geometric and chromatic characteristics of the warping in relation to the type of fabric to be made. The sum of the required finite times is a significant fraction of the total time of production for a beam 11.

The traditional systems, common to both the Suzuky and Hergeth warpers, provide for only one system 41 for the release of the thread from the thread-holding hook 25, and a plurality of thread presentation systems 31, 33 35 matching the number of channels installed in the warper. To the thread releasing system 41 is assigned the task of withdrawing the thread from the thread-holding hook 25 of the rotating arm 23 (or of the Hergeth-type belt), while the thread presentation system 31, 33, 35 is intended for presenting the thread to be picked up by the thread holding hook 25. The thread holding hook 25 has a purely passive function with respect to the operations of engagement and disengagement of the thread; its function is solely that of disposing the thread by winding it up along the warping support 19 or 119. Since the thread releasing system 41 is located in a fixed point along the periphery of the warping support and at a distance from the group 13, it is necessary that the idle times associated to the previously stated engagement and disengagement operations be added to the times for the return of the loop of the released thread; such loop is formed because the release system is positioned at a distance from its presentation channel; moreover, such loop has a length varying according to the distance of the channel from the releasing device, and becomes longer as the said distance increases. The said idle time stems from the fact that—as the thread holding hook 23, 25 is totally inoperative, as compared to the hooking and releasing operations—any thread presented along the its motion direction, prior to the complete return of the previous thread, would cause the engagement on the thread-winding hook 25 of all the threads on path thereof and, therefore, of both the new and previous thread.

With the systems currently in use, this thread loop is recalled by sliding the thread in the direction of the reel-holding creel (and thus, in a direction opposite to the one of normal sliding of the thread along the free span between the creel 3 and the group 13, during the very warping operation); such operation is carried out by the pierced disk 15 within which the thread is made to pass, which disk slides along the rails 17 in the up-to-down vertical direction, upon the step for the recovery of the thread loop and, viceversa, upon the step for the hooking up of the thread and the beginning of warping. The two extreme upward and downward positions of the disk 15 correspond, respectively, to the condition of the thread used for the warping or of the thread unused and thus at stand-by ready to be used. The motion of the disk 15 is caused only by the gravity and, accordingly, the return speed of the thread loop is merely determined by the weight of the disk 15. To reduce the idle times is thus necessary to increase the weight of the disk; such approach has however the drawback of significantly increasing the inertia of the same thread, which has to drive also the disk up to both ends of travel, and is limited by the thread strength. Moreover, such operation takes place during a crucial delicate step, that is, when the thread moves from the position of immobility to that of fast sliding as a consequence of its engagement by the thread-holding hook. A state of high inertia of the disk, in combination with high sliding speeds, may cause the breaking of the same thread due to a stress above its ultimate tensile strength. The operator has, therefore, to meet several requirements of different character between them:

- high thread-sliding speed (high rotational speed of the arm or of the thread-holding belt);
- use of considerable heavy thread-guide disks 15 (in order to speedily recovering the thread loop) to improve the machine productivity;
- limitation of the thread stress and thus of the weight of the disks 15, as heavy thread-guide disks increase the risk of thread breaking.

A trade-off between the opposing requirements is reached by introducing at least one or more idle rounds of the thread-holding hook 25, to allow the thread loop to come back without the need of using too heavy a disk; in case of high rotational speed, the number of idle revolutions is proportionally increased. However, since the change of the thread is a frequent operation, such practice has the drawback of reducing the warper productivity to an extent which is the higher the greater the number of idle rounds being introduced.

Provision may also be made for programming one or more idle rounds at a speed lower than the normal one of the arm 23 (or of the thread-holding belt) upon the warping stage.

Also to be considered is the fact that the need of recovering the thread loop restricts the use of a high number of channels 31, 33 simultaneously present in the warper; such channels members 31, 33 are in fact necessarily disposed along the path covered by the movement of the thread-holding hook 25 and are, therefore, at gradually increasing distances from the release station 41, so that each channel will form a loop of a size which is the higher the longer the distance of the channel from the release station, with consequent increase of idle times.

Before defining the object of the invention, it will be useful to point out that, in the known systems, the motion of the thread's release member 41 and presentation system 35 is provided by a mechanical system with electrical control, typically a solenoid with linear or rotary action. In the known systems, only a solenoid is present for the thread release, and as many solenoids for the thread presentation as the channels installed on the warper.

The invention is able to drastically reduce the above mentioned drawbacks. These and other objects of the invention will be apparent from a reading of the following description.

The invention relates to a system for the quick return of the yarn after the formation thereof in turns to be loaded onto a beam intended for a weaving loom, in a thread-by-thread warper comprising a support 19 or 119 for the turns; a thread holding member 23 with a thread-guide 25 driven into continuous motion for drawing a thread along and forming thread turns S on said support 19 or 119; a group 13 for retaining and presenting the threads and recovering them from said thread-holding member 23, 25, with a plurality of members 31, 33, 35 each of which being appointed to the handling of a thread coming from the creel; and a system for the release of the thread from the thread-guide 25 of said thread-holding member 23. According to the invention, said release system comprises a plurality of release devices interposed between said members 31, 33, 35 of said group, each of said devices being selectively controlled to operate the release of at least one of said threads.

The system may comprise a number of said release devices equal to that of said members and of the threads to be supplied, or a number of devices less than or equal to the number of said members and of the threads to be supplied.

Each of said release devices may be formed by a hooking element which is controlled by a solenoid actuator or the like, and is moved from a rest position to a position where said thread is released from said thread-guide 25 and vice versa, in synchronism with an oscillating hook 35 or equivalent element which intercepts the thread picked up by said hooking element.

The apparatus of the present invention, therefore, makes or allows a plurality of said channels to be provided with means to achieve the dual function of thread's presentation and release; that is, a system of self-contained channels performing the functions of hooking and release of the thread; such system replacing the centralized function of the current release system based on the use of only one release device.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figures 1, 2, 3:
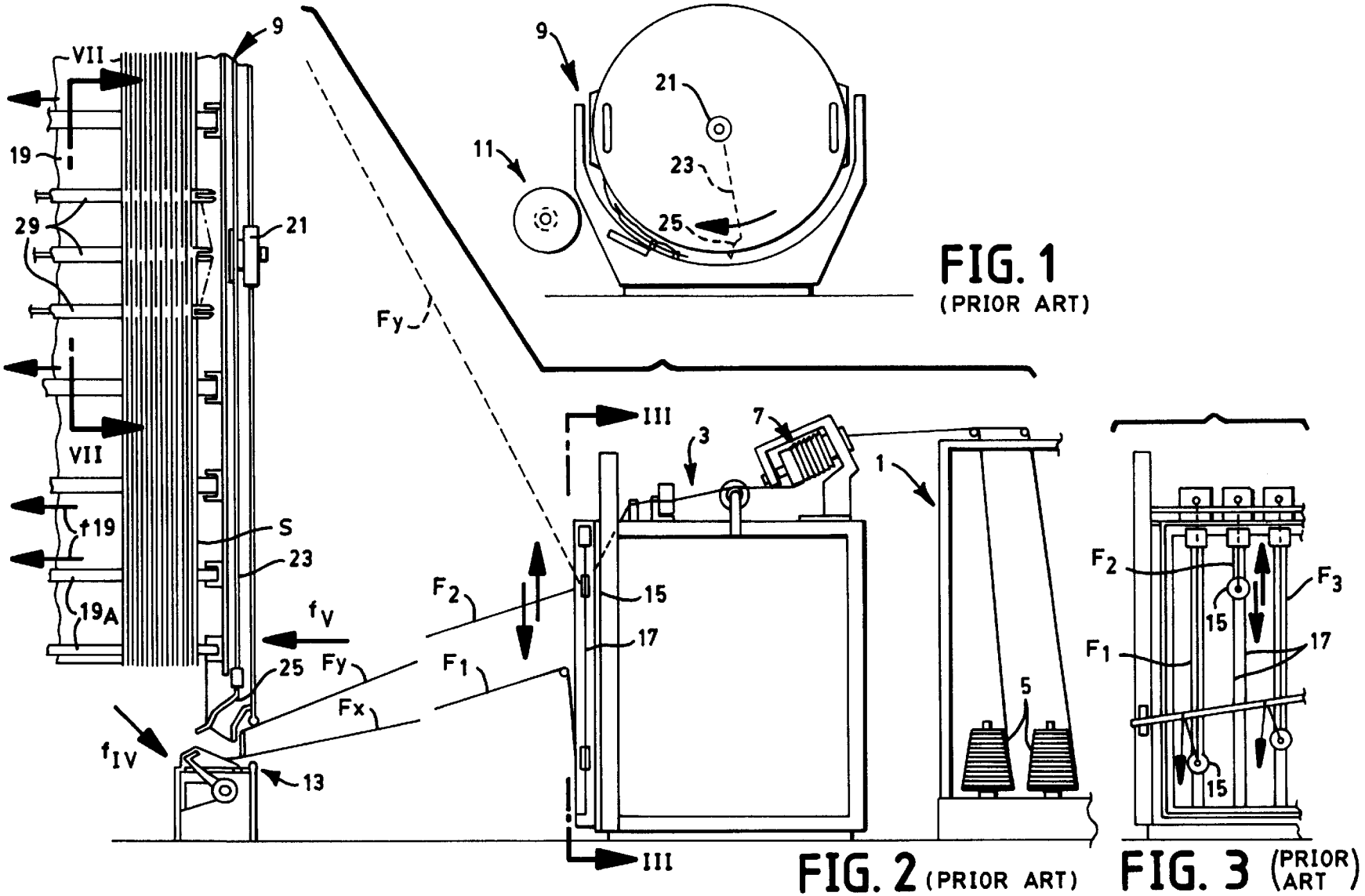
FIG. 1 (PRIOR ART)
FIG. 2 (PRIOR ART)
FIG. 3 (PRIOR ART)
FIGS. 1 through 10 show prior solutions which are described above.
Figure 4:
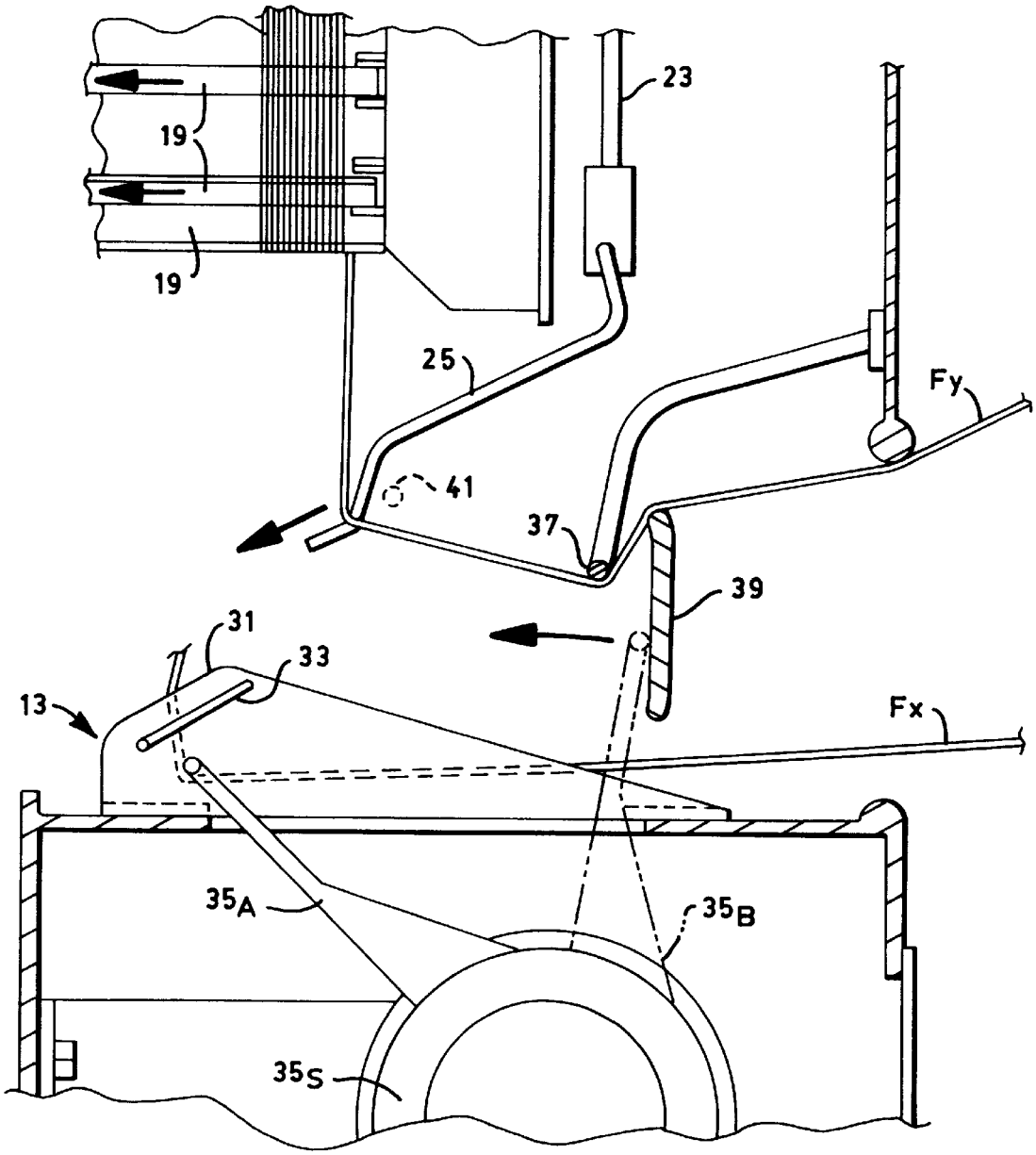
FIG. 4 (PRIOR ART)
Figure 5:
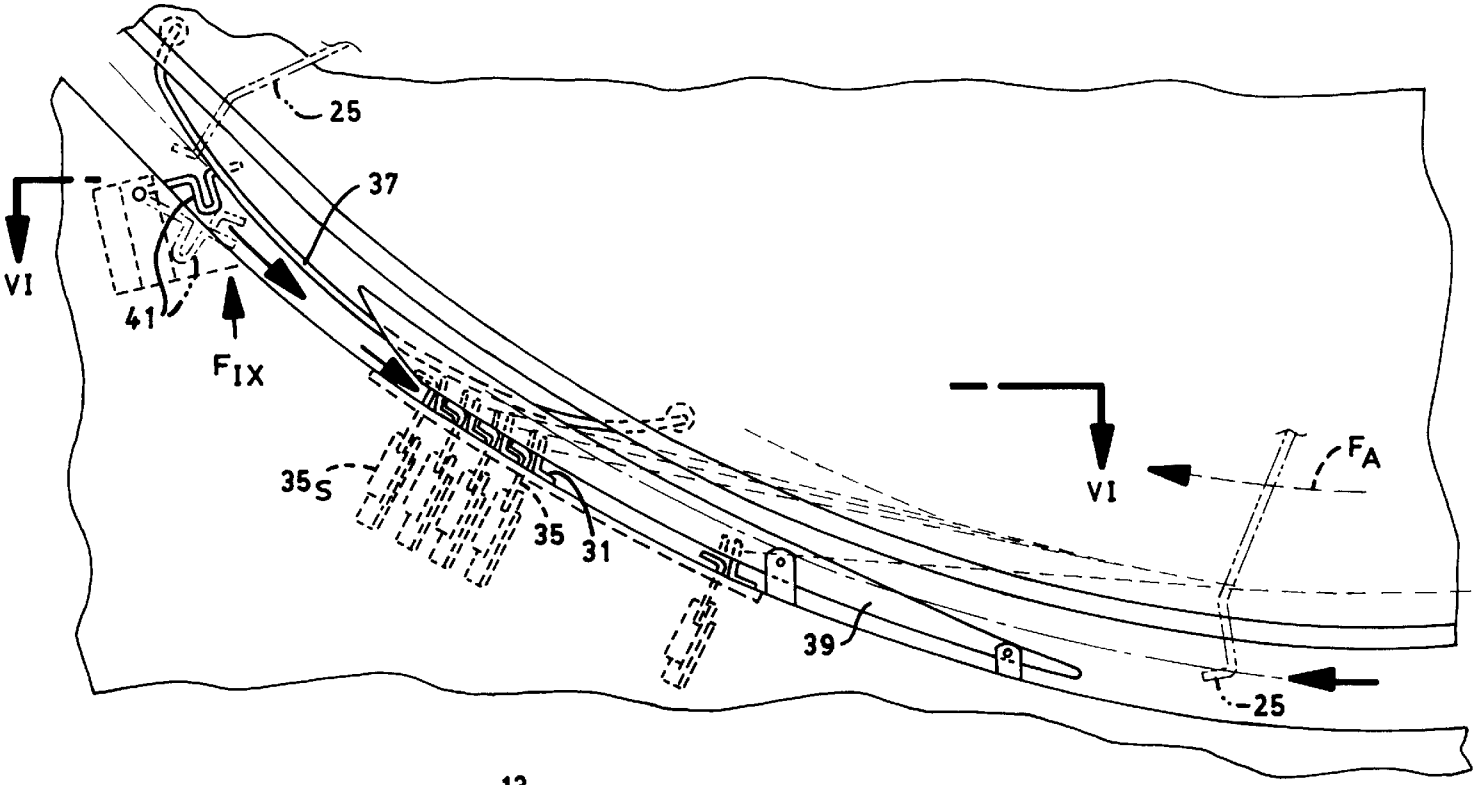
FIG. 5 (PRIOR ART)
Figure 6:
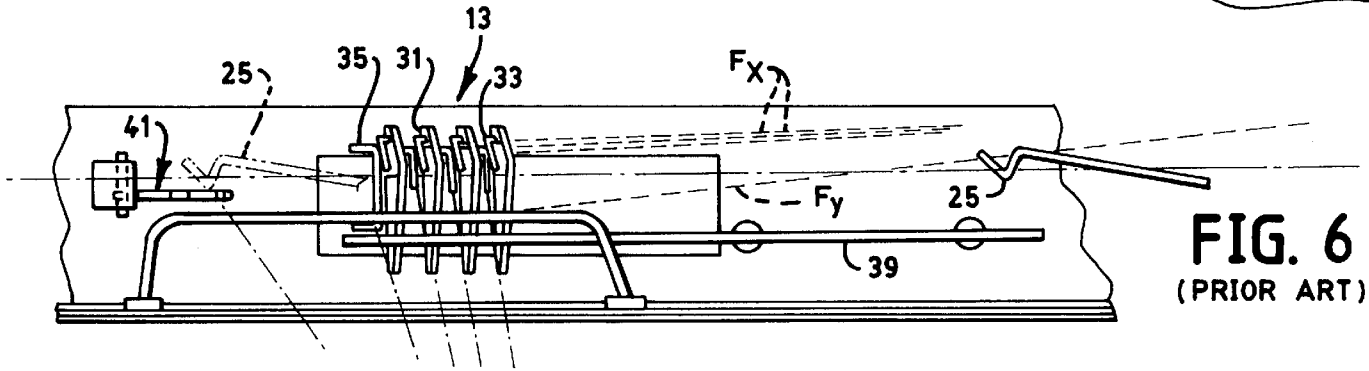
FIG. 6 (PRIOR ART)
Figure 7:
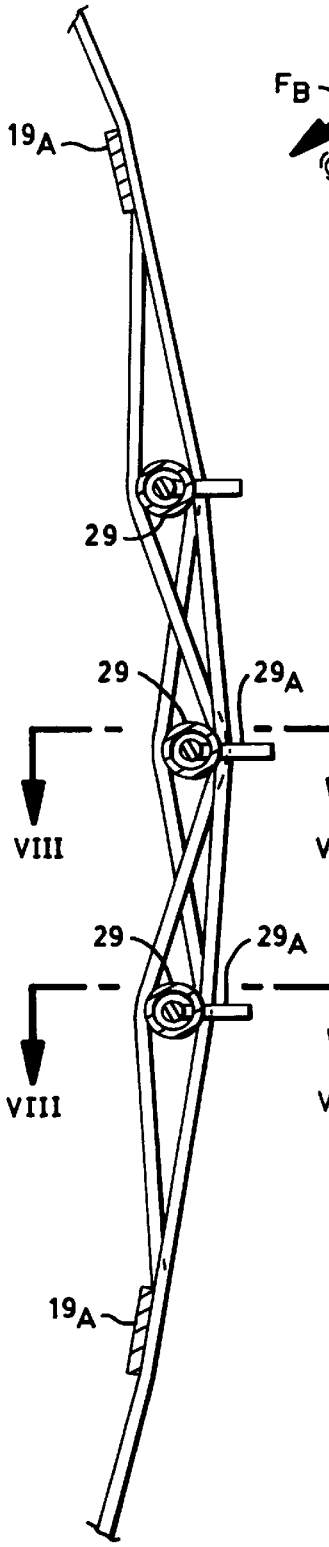
FIG. 7 (PRIOR ART)
Figure 9:
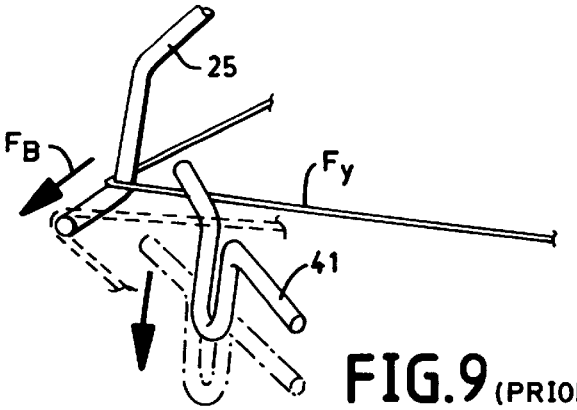
FIG.9 (PRIOR ART)
Figure 8:
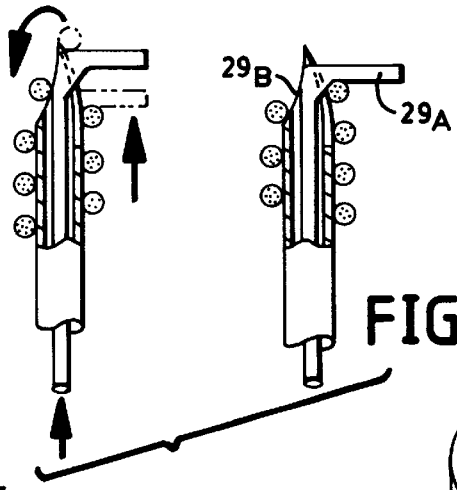
FIG.8 (PRIOR ART)
Figure 10:
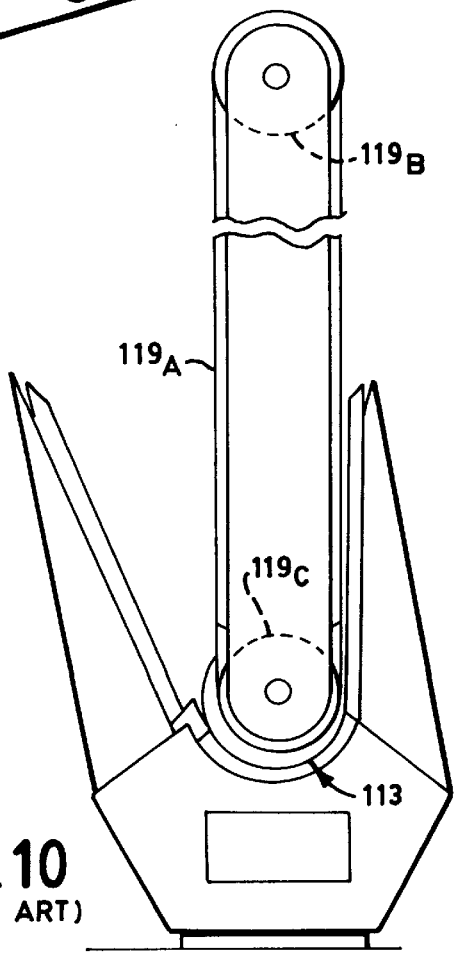
FIG.10 (PRIOR ART)

According to the invention, the single release system 41 is replaced—as illustrated in the drawing—by a plurality of release members 51 for the completion of group 13, disposed very close to each other and interposed between the members 31, 33, 35, and being possibly provided in such a number as to result one for each of said groups 31, 33 and 35.

Figure 11:
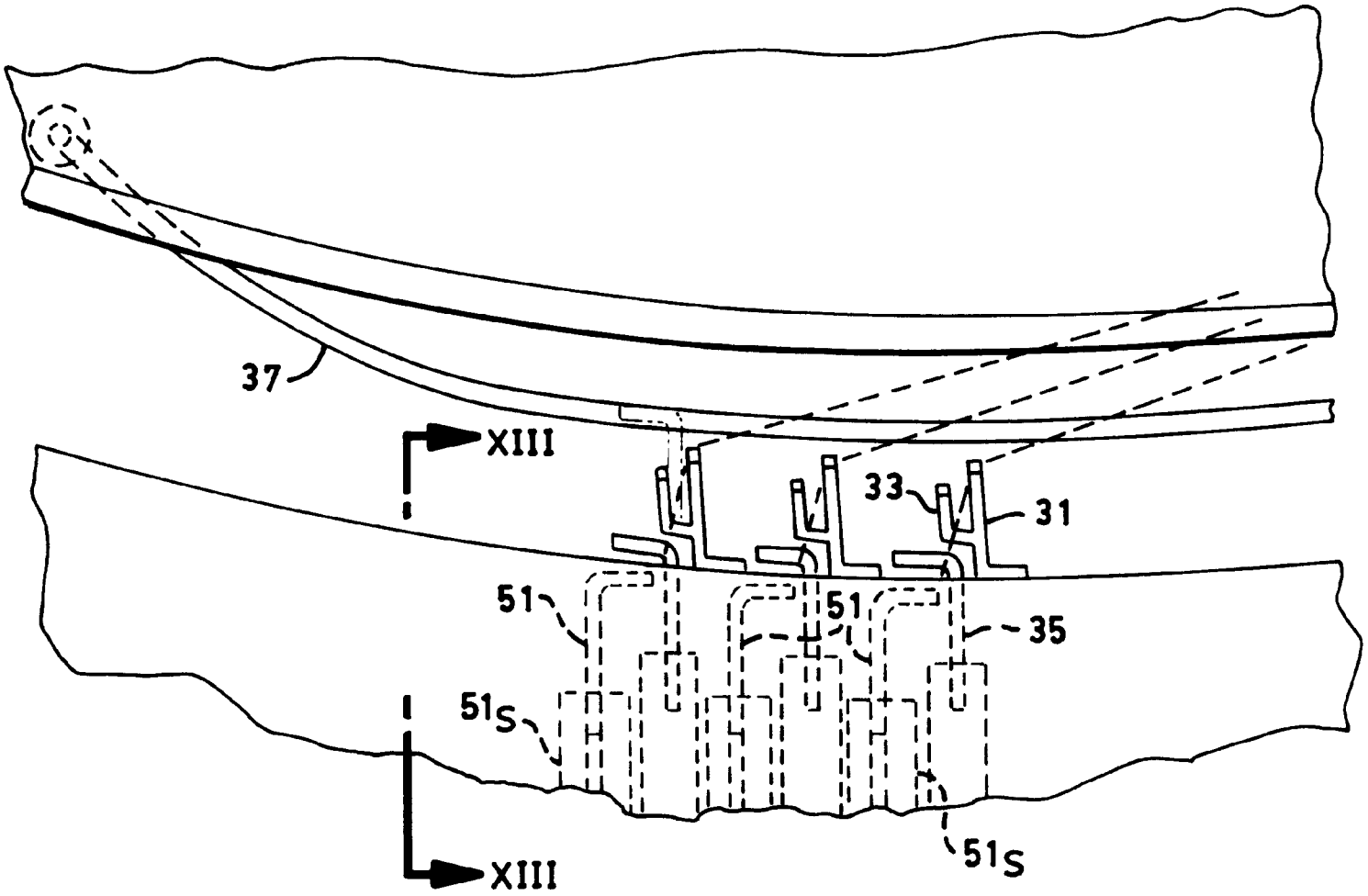
FIG. 11 is a detailed view showing features of the arrangement according to the invention in a view similar to FIG. 5 described above.
Figure 14:
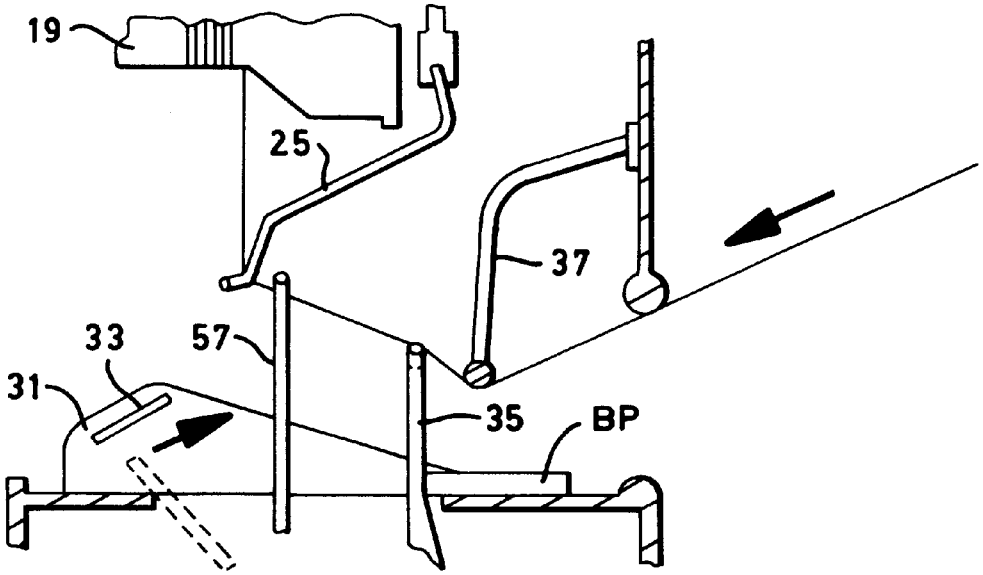
FIG. 14 shows a step of a thread winding cycle in a view similar to that of FIG. 4.
Figure 15:
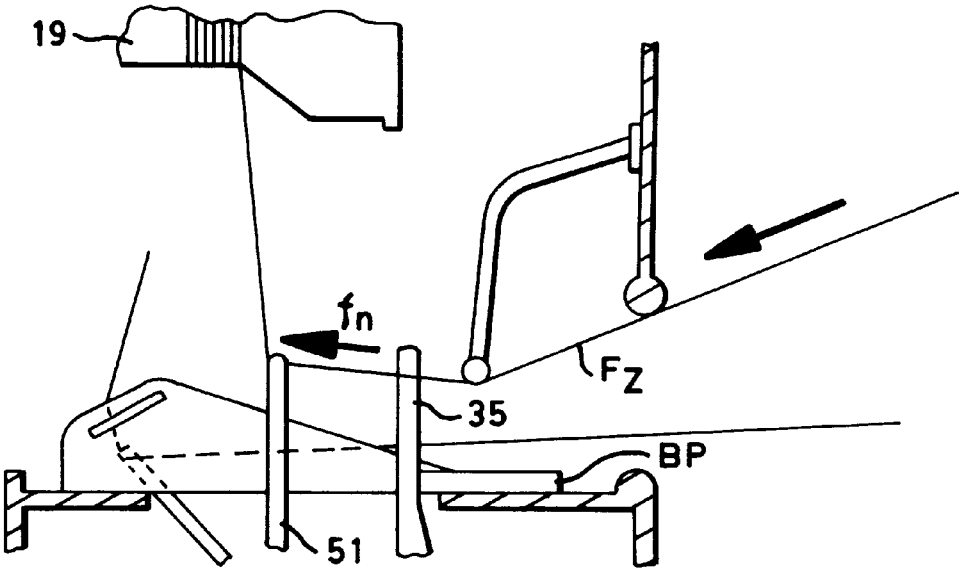
FIG. 15 shows a step of a thread winding cycle in a view similar to that of FIG 4.
Figure 16:
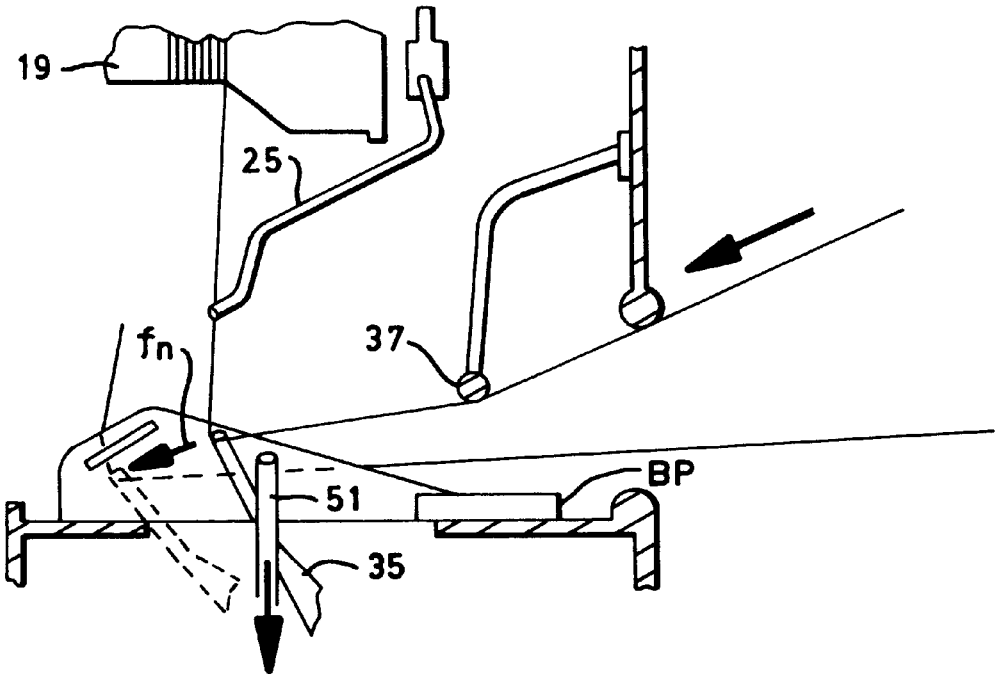
FIG. 16 shows a step of a thread winding cycle in a view similar to that of FIG. 4.

As shown in FIG. 11 and following figures, provision may also be made alongside each of groups 31, 33, 35, for a relevant release member 51 driven, for example, into straight (or even angular) motion by a corresponding solenoid actuator 51S with a solenoid control; it is not excluded, however, the provision of a different actuator of pneumatic type, for example. Accordingly, each of the driving members 51 may take up a position such as the one indicated with solid line in FIGS. 12, 13 and 17, a raised release position, as indicated in FIG. 14, and a third transfer position, as indicated in FIGS. 15 and 16, this transfer position being intermediate between the rest position and the release position.

Figure 13:
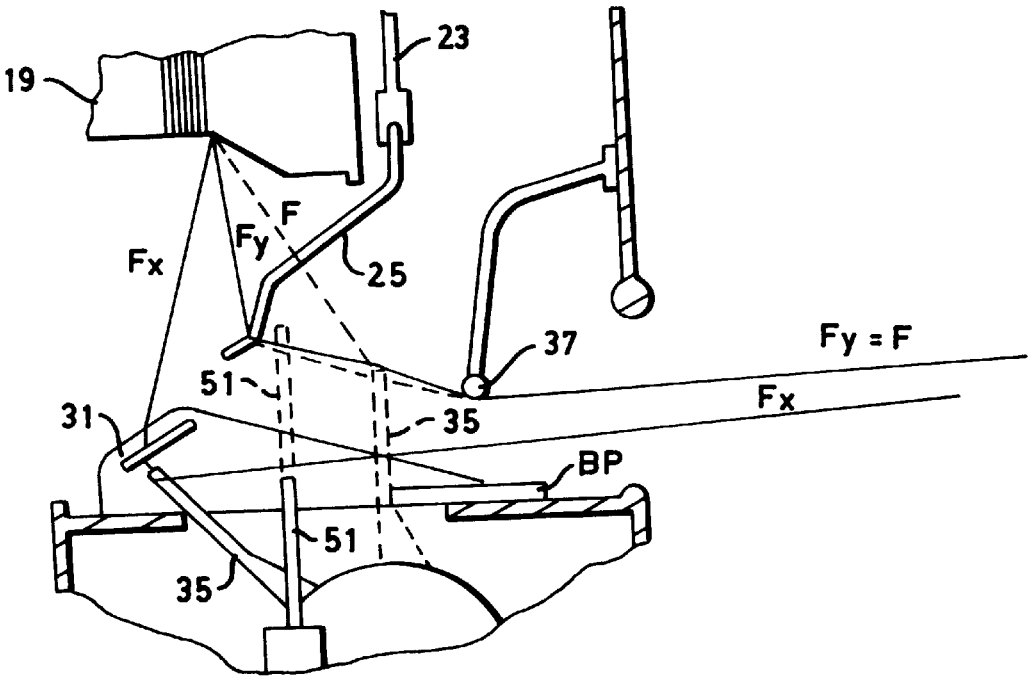
FIG. 13 shows a step of a thread winding cycle in a view similar to that of FIG. 4.
Figure 17:
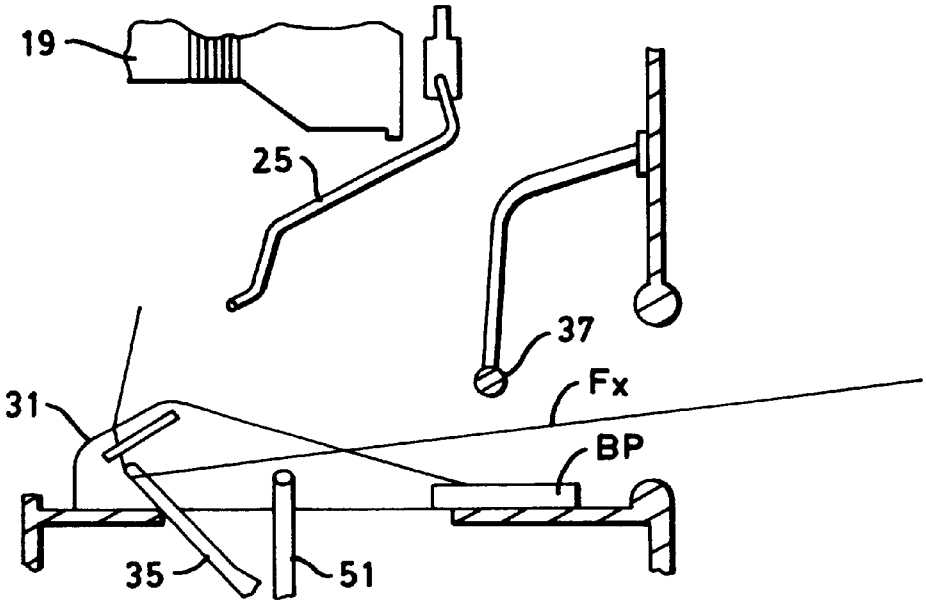
FIG. 17 shows a step of a thread winding cycle in a view similar to that of FIG. 4.

FIG. 13 shows a thread FY as it is driven by the thread winding hook or thread-guide 25 of the thread holding arm 23, while the other threads are in stand-by position, as it is the release member 51 in lowered condition. At the end of formation of the turns made by the thread FY to be unloaded, the release member 51 relevant to such thread is raised to the release position shown in FIG. 14, while the pertinent oscillating hook 35 is moved to the position of pick-up prearrangement. When the thread-guide 25 travels in front of group 13, the thread FY is intercepted by the release member 51 which disengages it from the thread-guide hook 25; said thread-guide continues its travel and is now able to receive a further thread, both before and after having performed a revolution about the cylindrical support 19. Soon after the thread FY has been disengaged from the thread-guide 25 and engaged by the release member 51, this release member 51 comes down to the intermediate position shown in FIG. 15, by driving the thread FY up to the position FZ as indicated in the same figure. At this point, the oscillating hook 35 is moved from the position shown in FIG. 15 according to arrow fn of FIGS. 15 and 16 up to the position indicated in said FIG. 16, so that the thread FZ is engaged by this oscillating hook 35 and driven up to the rest position FX shown in FIG. 17, while the release member 51 is also free to come farther down to reach the rest position, as shown in FIG. 17, which is the condition of members 35 and 51 indicated in FIG. 13.

It should be appreciated from the above that with the actuation of the release member 51 adjacent to members 31, 33 and 35 predisposed for the thread FY (which has fed the last formed turns onto the cylindrical support 19), the said thread does not exhibit lengths to be necessarily recovered, as in the case of the prior solutions illustrated in FIGS. 1 to 10, but it remains in a state of tension with no need for intervention by the relevant pierced disk 15.

The most advantageous arrangement appears to be the one which provides for the positioning of as many release members 51, with relevant actuators 51S, as are the groups of members 31, 33, 35 and, therefore, as are the different threads supplied by the reels. However, it is not excluded that, in order to obtain a substantially equivalent result, it could be even possible to provide a number of release members 51 lower than that of the group of members 31, 33, 35, that is, than the number of threads. The result would be derived from the suppression of a release member, such as the one indicated by 41, and by the presence of release members, such as those indicated by 51, in close proximity of the groups of members 31, 33, 35, possibly with the provision of one release member for each of them.

Figure 12:
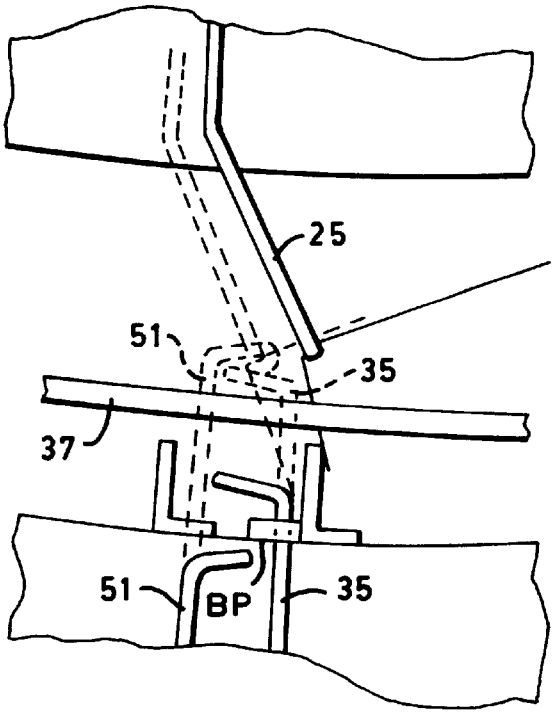
FIG. 12 is a partial enlargement of the view of FIG. 11.

The so-called saber cam 39 is omitted from the design according to the invention and the thread-guide 37 is modified, according to the embodiment of FIGS. 12 and 13, to make up a resting surface for the member 35.

The advantages of the invention are evident, when compared with the previously indicated traditional system which are based on a single release device. Moreover, it should be noted that the cost increase is relatively modest, since it is only necessary to provide the warper with a higher number of release devices 51, 51S which, however, are made up of solenoids or other low-cost actuators; the rise in the cost will be thus limited to that for the additional solenoids and for the relatively simple mechanism 51 to be operated; the operating kinematic section is also very simple, as it is limited to a control member 51 made of wire shaped in a suitable form. The logic level of the electronic circuits for the control of the additional actuators 51S shall not be necessarily complex, as all the information relevant to the channel in use will be already present within its control logic; under these conditions, the increment in the electronic circuits is merely reduced to the driver of each actuator.

It is evident from above that many advantages can be obtained, the main of which can be summerized as follows:

minimum or no presence at all of loops of thread to be recovered during the release stage;

possibility of reducing the time for the thread recovery almost to zero;

no resort to the use of heavy disks 15 for the recovery of the thread, with consequent reduction of their inertia;

possibility of using high rotational speed of the thread holding hook 25, as a consequence of the reduced inertia of the thread which is due, in turn, to the possibility of reducing the weight of the disks 15; under these circumstances, the maximum rotational speed of the arm 23 and of thread holding hook 25 will be determined solely by the characteristics of strength of the thread;

possibility of excluding idle rounds or reducing them to one only, upon every thread change operation;

possibility of increasing the speed also during the change stage so as to minimize the idle, non-productive times;

possibility of introducing a virtually unlimited number of channels, as a consequence of the suppression of the thread loops, and possibility of using an arc of considerable extent as a front for receiving the group 13 of threads'presentation and retention systems 31, 33, 35.

A precautionary estimate of these advantages allows to foresee a productivity increase of 30%, the conditions and type of yarn being equal.

In FIG. 13, the letter F indicates a thread in a presentation stage and in FIGS. 12–17, BP indicates a fixed abutment element at the end of travel of the member 35.

Figure 18:
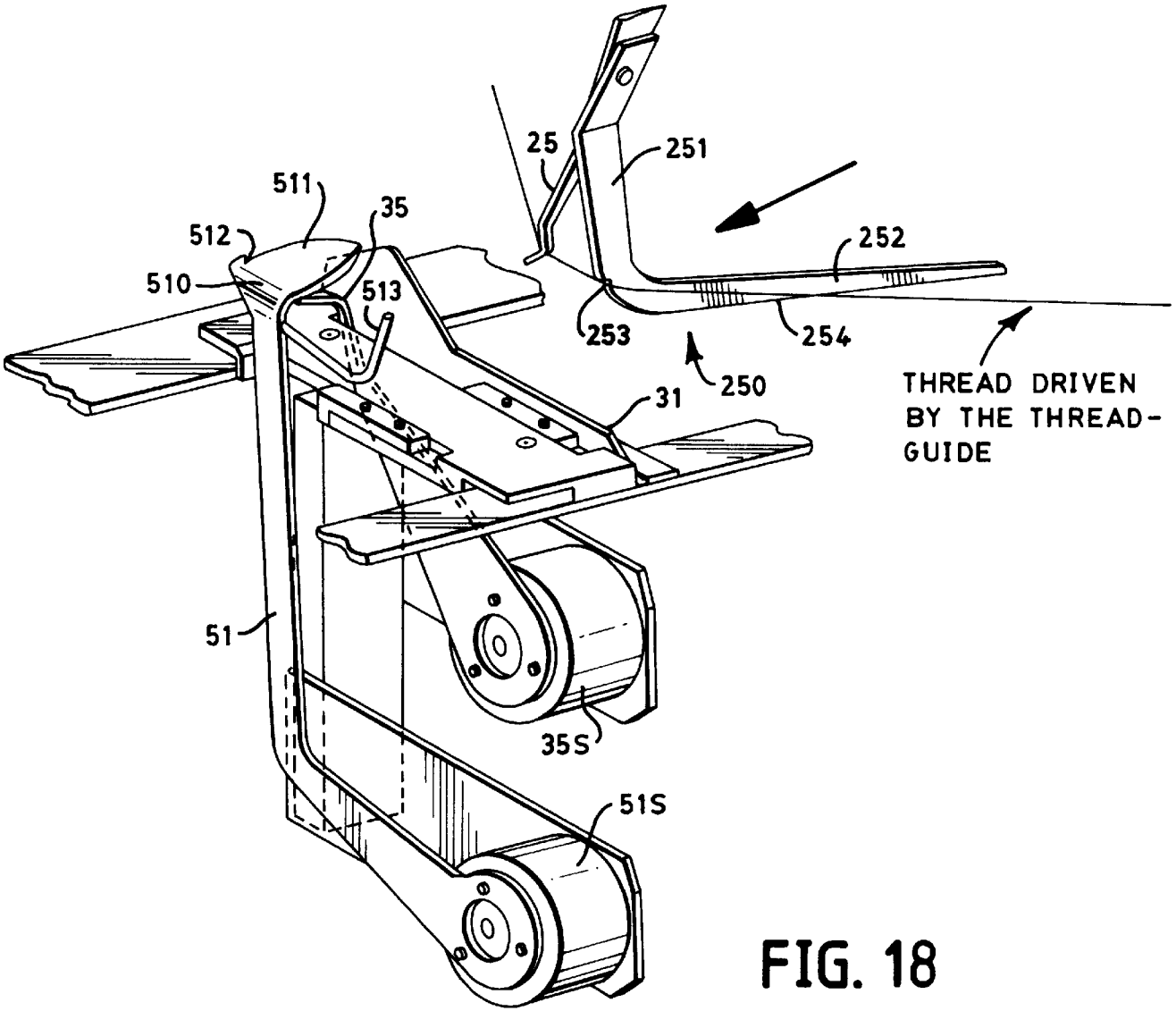
FIG. 18 is a perspective view showing various work steps of a further embodiment of the apparatus according to the invention.
Figure 19:
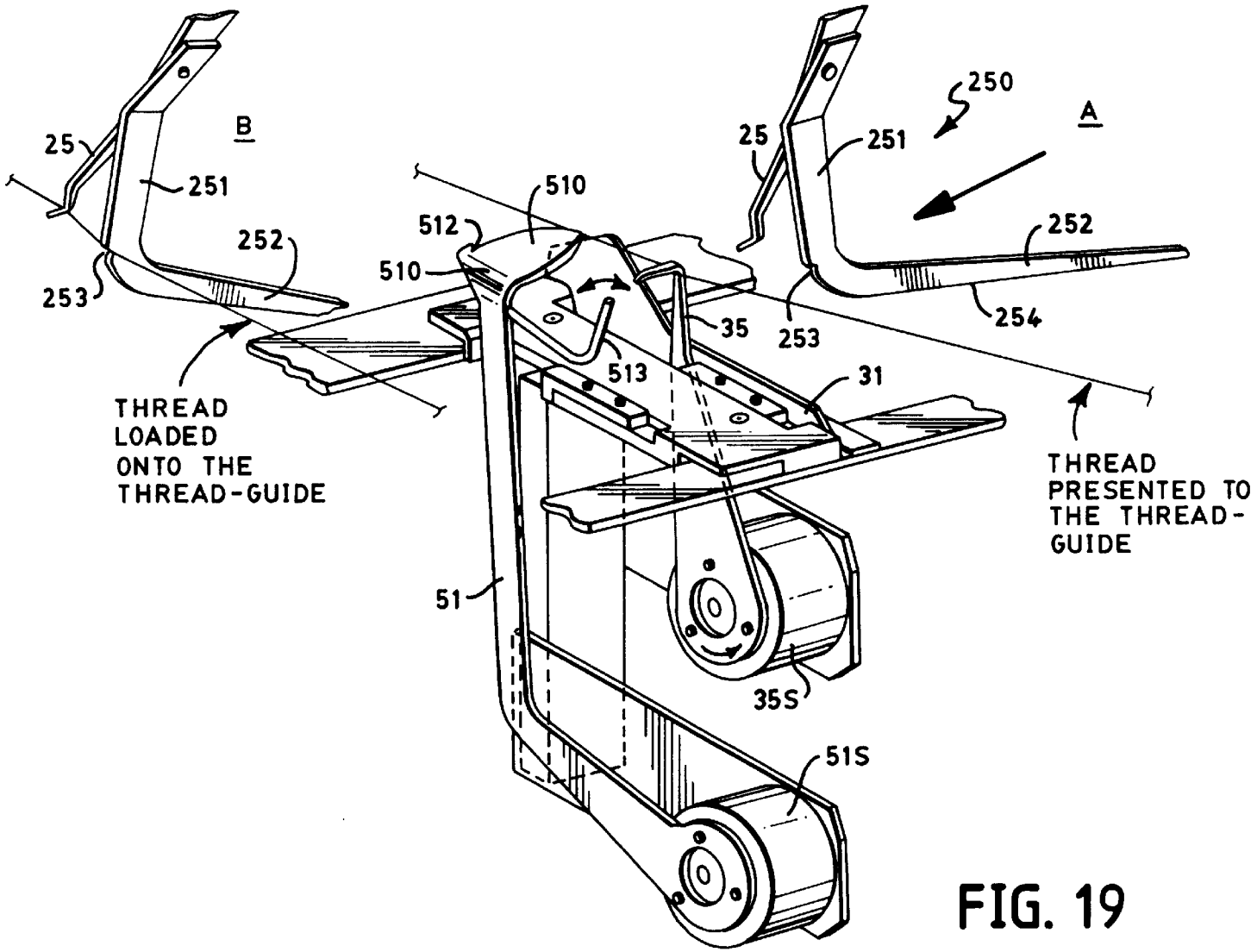
FIG. 19 is a perspective view showing various work steps of a further embodiment of the apparatus according to the invention.
Figure 20:
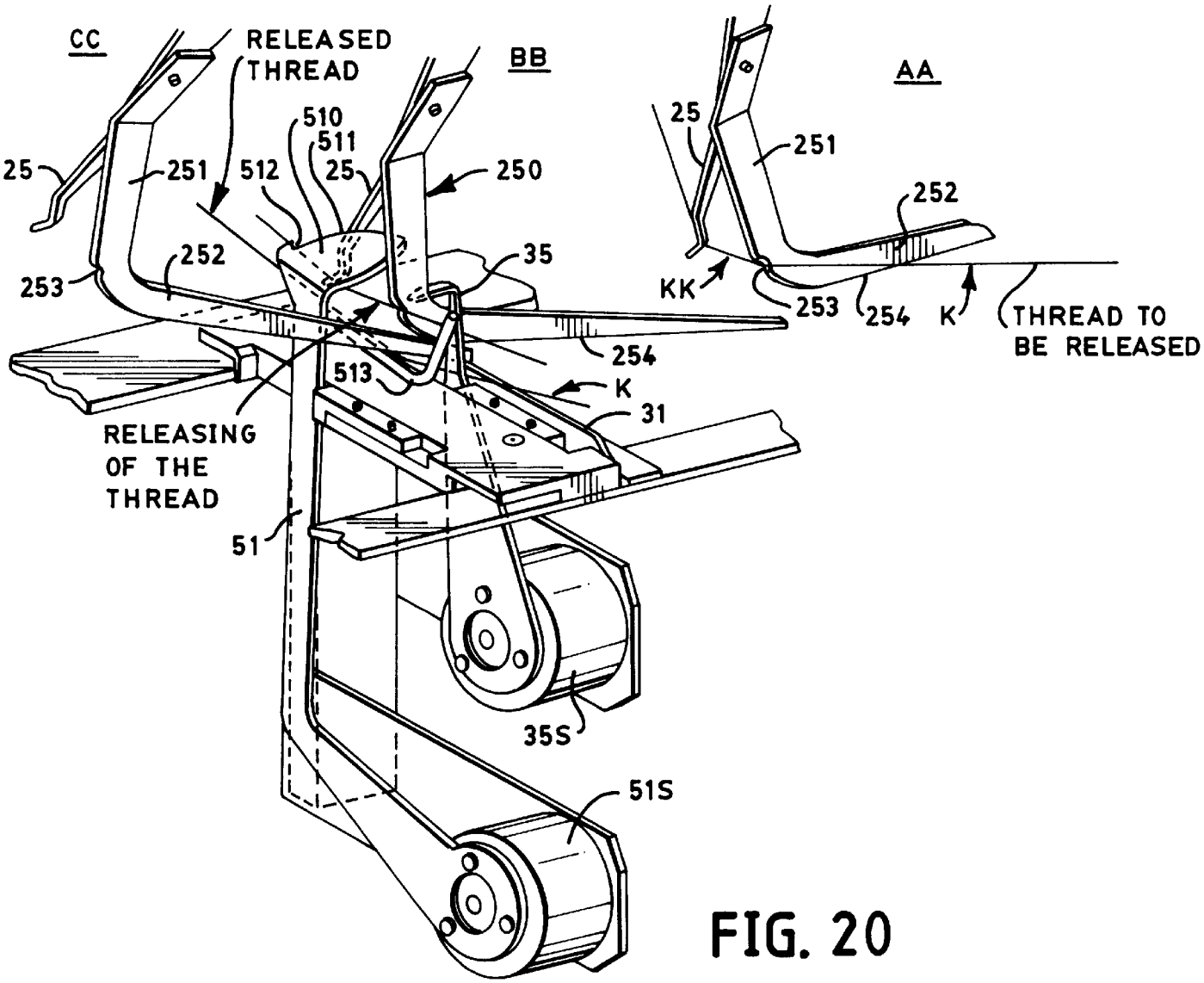
FIG. 20 is a perspective view showing various work steps of a further embodiment of the apparatus according to the invention.

Referring now to FIGS. 18–20 of the drawings, and according to a further embodiment of the same invention, each release member 51 has an upper portion 510 so shaped as to present a convex edge 511, with the convexity facing the region of transit of the thread to be released, a flaring recess 512 being formed on said edge for the thread to be released from the rotatory thread-guide 25, and acting in cooperation with an appendix 513 of predetermined height and stemming from the member 51, on the side of the latter which faces the thread-supplying reels, as described later on in greater detail. Emerging from the rotating thread-guide 25 on the side facing the said reels is an appendix 250 with a first portion 251 thereof diverging from the axis of the thread-guide 25, and with a second portion 252 suitably radiused to the first one and developed in a plane substantially orthogonal to the axis of rotation of the thread-guide 25. Provided at a predetermined location of the front edge of the appendix 250—with respect to the direction of movement of the thread-guide 25—is a recess of reduced dimensions serving to improve the hold of the thread carried by the thread-guide and being wound up onto the warper drum. The divergence angle of the portion 251 of the appendix 250 with respect to the axis of development of the thread-guide 25, the height of the portion 251, and the position of the depression 253 on the front edge of the appendix 250, are all chosen so that, upon the release of the thread from the thread-guide, the portion KK of the thread between the free end of the thread-guide 25 and said depression be forced to place itself in the space between the portion 511 and the appendix 513 of the release member 51 disposed in thread releasing condition.

Shown in FIG. 18 is the case of a channel not involved in the release of the thread from the thread-guide 25 and, accordingly, with the members 51 and 35 being at rest and the thread-guide 25 running in correspondence of said members without intercepting the thread driven along by them.

FIG. 19 shows the presentation of a thread to the rotative thread-guide 25. In this case, the member 35 is in work, that is, raised condition, while the release member 51 is at rest. With the member 35 driven into operative condition by the respective rotative magnet 35S, the relevant thread results in such position as to be intercepted by the thread-guide 25 which travels in front of the channel and, therefore, able to be held and driven along by the latter without any obstacle. In the position A, the thread-guide 25 is upstream of the presentation member 35 and, therefore, having no thread yet. In the position B, the thread-guide 25 has already loaded the member 35.

FIG. 20 shows the step of release or expulsion of a thread from the rotating thread-guide 25. Both members 35 and 51 are in work, that is, raised condition. Upon the passage of the thread-guide 25 in front of the channel, the portion K of thread facing the reels comes in contact with the appendix 513 of the member 51. At the same time, the said portion KK of the thread passes under the edge 511 of the element 510 and is guided towards the recess 512. In this way, owing to the typical shape of the free end of the rotating thread-guide 25, which is such as to facilitate the release of the thread, to the guiding action operated by the edge 511 of the member 51, and to the retention operated by the recess at 512, the thread comes off from the thread-guide 25. During this stage, the lower edge 254 of the appendix 250 of thread-guide 25 makes the corresponding portion of the thread to dwell in the space between the elements 510 and 513 of the member 51, thereby preventing the thread from going over the appendix 513. Owing to the tension that the thread is to withstand, the portion 252 of the said appendix 250 causes the thread to lie below the upper end of the member 35 as well. In this way, with the subsequent lowering of both the members 35 and 51, there is ensured that the thread will result always in the correct and safe position for any subsequent further presentation thereof to the rotating thread-guide 25. Indicated in AA is the rotating thread-guide 25 with the thread to be released, in BB is the thread-guide 25 upon the release of the thread, and in CC is the thread-guide 25 after the release of the thread.

It should be appreciated that the control of the members 35 and 51 may be of linear, instead of rotative type, with no substantial modification of the above described operating steps.

It should be understood that the drawing shows an exemplification of the invention given only as a practical demonstration thereof, the same invention being possibly modified in the forms and dispositions without departing from the scope of the idea on which it is based. The presence of reference numbers in the attached claims has the purpose of facilitating the reading thereof and does not limit the scope of the protection represented by the same claims.

I claim:

1. An apparatus for the positioning of yarn after the formation of the yarn in turns on a support in a warper utilizing a programmed thread-by-thread warping system, the apparatus comprising:

said support for thread turns;

a thread holding member with a thread-guide driven into continuous motion for drawing a thread along and forming the thread turns on said support;

a thread device for retaining and presenting and recovering thread from said thread-holding member, said thread device including a plurality of members each of which handles thread coming from a creel; and a release system for the release of thread from said thread-guide of said thread holding member, wherein said release system comprises a plurality of release devices associated in close proximity to said members of said thread device, each of said release devices including means for being selectively controlled to operate the release of at least one of said threads, one of said release devices being disposed immediately downstream of said plurality of members, with respect to a direction of motion of said thread holding member.

2. The apparatus according to claim 1, wherein a number of said plurality of release devices is equal to that of said members and equal to a number of threads to be supplied.

3. The apparatus according to claim 1, wherein a number of said plurality of release devices is less than a number of said members and is less than a number of threads to be supplied.

4. The apparatus according to claim 1, wherein a number of said plurality of release devices is equal to half the number of said members and equal to half the number of threads to be supplied.

5. The apparatus according to claim 1, wherein each of said release devices comprises a release element which is controlled by a solenoid actuator and is moved from a rest position to a position where said thread is released from said thread-guide and vice versa, in synchronism with an oscillating hook which intercepts the thread picked up by a hooking element and moved to an intermediate position of said hooking element.

6. The apparatus according to claim 1, comprising a thread cam or thread-guide cam, wherein said thread-guide of said thread holding member is modified to provide a longer distance from the support cylinder, in order to form an abutment for the hook.

* * * * *